US008413565B2

(12) United States Patent
Herrmann et al.

(10) Patent No.: US 8,413,565 B2
(45) Date of Patent: Apr. 9, 2013

(54) DRIVE AND QUICK STOP FOR A WEAPON WITH PREFERABLY A LINEAR BREECH OR AMMUNITION FEED

(75) Inventors: Ralf-Joachim Herrmann, Senzig (DE); Klaus Lawitzke, Magdeburg (DE); Heiner Schmees, Celle (DE); Berthold Baumann, Eschede (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 109 days.

(21) Appl. No.: 13/154,170

(22) Filed: Jun. 6, 2011

(65) Prior Publication Data

US 2011/0314996 A1 Dec. 29, 2011

Related U.S. Application Data

(63) Continuation-in-part of application No. PCT/EP2009/007975, filed on Nov. 7, 2009.

(30) Foreign Application Priority Data

Dec. 4, 2008 (DE) ..... 10 2008 060 216

(51) Int. Cl.
*F41A 3/00* (2006.01)

(52) U.S. Cl.
USPC ..... 89/17; 42/2; 42/14

(58) Field of Classification Search ..... 42/2–49.1; 89/125–199, 9–13.1, 17–26
See application file for complete search history.

(56) References Cited

U.S. PATENT DOCUMENTS

| | | | | |
|---|---|---|---|---|
| 430,206 | A | 6/1890 | Garland | |
| 475,276 | A | 5/1892 | Garland | |
| 1,424,751 | A | 8/1922 | Bangerter | |
| 2,378,191 | A * | 6/1945 | Corte | 89/33.16 |

(Continued)

FOREIGN PATENT DOCUMENTS

| | | | |
|---|---|---|---|
| CH | 675 767 | A5 | 10/1990 |
| DE | 70863 | C | 9/1893 |

(Continued)

OTHER PUBLICATIONS

Notice of Allowance issued in co-pending related U.S. Appl. No. 13/154,108 on Nov. 19, 2012.

(Continued)

*Primary Examiner* — Samir Abdosh
(74) *Attorney, Agent, or Firm* — Griffin & Szipl, P.C.

(57) ABSTRACT

A drive, having a quick stop mechanism, for a breech is axially adjustable relative to a weapon barrel, and includes a motor, two counter-rotating chains and sprocket wheels that guide the chains. Engaging cams and control cams are integrated into the chains. A slide mounted at the bottom of the breech is displaceable transversely to the direction of fire and has a groove that the engaging cams engage to entrain the breech in a forward or reverse motion relative to the direction of fire. The engaging cam transporting the breech forwards is displaced from the groove while the control cam displaces the slide simultaneously to its center position via its ascent ramp, thereby allowing breech rest periods in the forward limit position. Firing causes the slide to move from the center position to the left hand side whereas it remains in the center position when no shot is fired.

18 Claims, 4 Drawing Sheets

U.S. PATENT DOCUMENTS

| | | | | | |
|---|---|---|---|---|---|
| 2,604,820 | A | | 7/1952 | Schiff | |
| 3,501,998 | A | | 3/1970 | Dardick | |
| 3,503,300 | A | * | 3/1970 | Dardick | 89/8 |
| 3,648,561 | A | | 3/1972 | Stoner | |
| 3,834,272 | A | * | 9/1974 | Patenaude et al. | 89/12 |
| 4,154,142 | A | | 5/1979 | Schwegler | |
| 4,301,709 | A | * | 11/1981 | Bohorquez et al. | 89/11 |
| 4,481,858 | A | * | 11/1984 | Price | 89/11 |
| 4,563,936 | A | * | 1/1986 | Cleary et al. | 89/11 |
| 4,686,886 | A | * | 8/1987 | Caserza et al. | 89/11 |
| 5,134,922 | A | | 8/1992 | Menges et al. | |
| 5,353,678 | A | * | 10/1994 | Rochelle et al. | 89/9 |
| 6,009,791 | A | * | 1/2000 | Medlin | 89/38 |
| 2011/0290103 | A1 | | 12/2011 | Herrmann et al. | |
| 2011/0314996 | A1 | * | 12/2011 | Herrmann et al. | 89/17 |
| 2012/0132061 | A1 | * | 5/2012 | Herrmann et al. | 89/17 |
| 2012/0132062 | A1 | | 5/2012 | Herrmann et al. | |

FOREIGN PATENT DOCUMENTS

| | | | |
|---|---|---|---|
| DE | 30 21 200 | A1 | 12/1980 |
| DE | 32 16 813 | A1 | 11/1983 |
| DE | 3218550 | A1 | 11/1983 |
| DE | 37 12 905 | A1 | 11/1988 |
| DE | 36 27 361 | C1 | 4/1992 |
| DE | 10 2005 045 824 | B3 | 4/2007 |
| DE | 10 2006 022 622 | A1 | 11/2007 |
| DE | 10 2007 048 468 | A1 | 4/2009 |
| DE | 10 2007 048 470 | A1 | 4/2009 |
| DE | 10 2007 054 470 | A1 | 5/2009 |
| EP | 1 767 891 | A1 | 3/2007 |
| FR | 538 190 | A | 6/1922 |
| GB | 577 338 | | 5/1946 |
| JP | 6-159991 | | 6/1994 |
| JP | 7-139 896 | A | 6/1995 |
| JP | 7-174 491 | A | 7/1995 |
| WO | 2009/049723 | A1 | 4/2009 |
| WO | 2009/062585 | A1 | 5/2009 |

OTHER PUBLICATIONS

International Search Report, International Application No. PCT/EP2009/07975, completed Jan. 29, 2010 and mailed Feb. 10, 2010.

M242 Bushmaster, from Wikipedia, the free encyclopedia; http:/en.wikipedia.org/wiki/M242_Bushmaster, downloaded May 24, 2011.

International Search Report issued in related International Application No. PCT/EP2009/007977, completed Jan. 29, 2010, mailed Feb. 10, 2010.

http://en.wikipedia.org/wiki/M242_Bushmaster, M242 Bushmaster—Wikipedia, the free encyclopedia, downloaded May 9, 2011, pp. 1-7.

International Search Report issued in related International Application No. PCT/EP2009/007976, completed Jan. 29, 2010, mailed Feb. 9, 2010.

International Search Report, International Application No. PCT/EP2009/07974, completed Jan. 29, 2010 and mailed Feb. 10, 2010.

http://www.knightswoodsecondary.org.uk/personal/Resources/Hillhead/Credit_Worksheets/CompositeAreas.pdf; downloaded May 29, 2011.

* cited by examiner

DRIVE AND QUICK STOP FOR A WEAPON WITH PREFERABLY A LINEAR BREECH OR AMMUNITION FEED

This is a Continuation-in-Part application in the United States of International Patent Application No. PCT/EP2009/007975 filed Nov. 7, 2009, which claims priority on German Patent Application No. DE 10 2008 060 216.7, filed Dec. 4, 2008. The entire disclosures of the above patent applications are hereby incorporated by reference.

FIELD OF THE INVENTION

The present invention pertains to a drive provided with a quick stop device for a breech, or breech support, which can be moved in the axial direction with respect to a weapon barrel of a weapon.

BACKGROUND OF THE INVENTION

Various drives, such as external drives or self-drives, for weapon systems are known from the prior art. Electrical drives are frequently provided for external drives, and these then, for example, drive a chain. One known chain drive is used in the machine gun known by the name "Bushmaster," or else "chain gun." In this case, the times during which the breech has to be stationary for closing it, in order to fire the shot, in order to open the breech and to place a cartridge in front of the breech, are implemented by a revolving chain, which is driven by a motor (http://de.wikipedia.org/wiki/M242 Bushmaster). In this case, the breech, together with the round or cartridge in front of it, is fed linearly to the cartridge chamber.

DE 10 2006 022 622 A1 describes a linear feed for the round into a weapon barrel or cartridge chamber, which feed has a control guide, which is used for function control, on the horizontal plane parallel to the movement of a breech, which has to be guided linearly, for the breech-loading weapon. This functionally interacts with a so-called "drive guide," which is likewise located on the horizontal plane, for guiding a means connected to the breech. The drive guide is integrated in a movable slider, which is itself moved by a universally configurable drive. Furthermore, a locking guide is provided for locking the breech, and is preferably integrated in the movable slider together with the drive guide. A bolt on a locking ring, which is preferably arranged on the weapon side, can engage in this locking guide. This bolt then itself moves the locking ring. Within the control guide and the drive guide, which interact with one anther, a connecting rod, or the like, is positively guided by the guides and the slider along these guides. The breech is moved backward and forward by means of this connecting rod.

Building on this, DE 10 2007 048 468.4, which was not published prior to the earliest priority date for the present patent application, considers in more detail a drive for the linear feed of the round into a weapon barrel or cartridge chamber by means of a chain. The chain itself is passed in a simple manner closely around two sprocket wheels. A chain link or a stud on the chain is integrated in a guide or groove that is located underneath the movable slider. This allows the chain to continue to run during the times in which the weapon is stationary, and which are defined by the function control. The chain itself can be driven by an electric motor.

Since, in the case of an external drive, the breech movements take place independently of the gas pressure in the weapon barrel, it is necessary to prevent the breech from being opened in the event of a misfire (i.e., defined in this case when the propellant charge in the cartridge does not burn away after the firing energy has been supplied), or a late fire (i.e., defined in this case as when the propellant charge burns away with a considerable time delay). In general, the gas pressure or the weapon barrel itself is, for this purpose, detected as an indication of correct burn-away. If this information is lacking, a so-called "quick stop" must be initiated, and the opening of the breech must be prevented.

The mass forces during breaking of the external drive, in order to prevent opening, result in high loads in or on the elements of the drive train, particularly, at relatively high firing rates.

DE 10 2007 048 470.6, which was not published prior to the earliest priority date for the present patent application, deals with the problem of a so-called quick stop in externally driven weapons. The quick stop is inserted all the time, and is moved out again when a shot is fired correctly. However, in the event of a misfire, a means, which is functionally connected to the weapon recoil, runs onto the quick stop, the drive movement is stopped, and the breech is not unlocked, at least for a predeterminable time.

DE 30 21 200 C2 discloses a protection system against late firing or subsequent firing. In addition to having a sensor for detection of recoil, the weapon is equipped with a quick stop that can be moved to a position pushed in with respect to the chain part, in order to stop a normally continuously moving chain part, and therefore to stop the movement of the breech. A locking apparatus, which responds to the sensor, controls the movement of the stopping apparatus between the pushed-in position, in which the chain part is stopped, and an extended position, in which the movement of the chain part is otherwise not impeded. The protection system has two elements, which are connected to the chain part, a main element and a safety element, as well as a trigger rod that is controlled by a solenoid, and a recoil push rod. The recoil push rod is used to release a recoil catch bolt when the shot is fired, and the trigger rod is used to move the safety element down when the weapon is locked, and to release it when the round has been correctly fired. In order to subsequently stop the weapon, the trigger rod acts on the main element, since the solenoid is switched off. However, an electrically controlled solenoid, such as this, is particularly undesirable in safety devices of this type because it is itself susceptible to defects. The possibility of the material of the rods fracturing furthermore means that the safety device is not functionally reliable. In addition, the design of the entire unit is very complex.

DE 32 18 550 C2 discloses a blocking device for a machine gun having an externally driven breech drive. In this case, energy that results from the shot firing is used for a shot monitoring device in order to interrupt the external power supply. When a shot is not fired and there is no return movement, this prevents a control stud of the device from being moved out of a pulled-back position to a driving position, while a switching lever is transported by an interrupter stud to a position in which the power supply is continuously restricted. The disadvantage of this solution is, likewise, the high level of design complexity, and the weight associated with this complex design.

DE 10 2007 054 470.9, which was not published before the earliest priority date for the present patent application, deals with a drive for a weapon with a linear round feed, which is distinguished in that the linear feeding of a breech to the weapon barrel, or cartridge chamber, is achieved by means of a linear guide groove in drive kinematics. A driver is guided in the guide groove and is physically connected to the breech. The guide groove is surrounded by a circumferential positive guide (slotted guide), which itself interprets the necessary times during which the breech is stationary during locking, firing, unlocking in its front position and reloading. A further means is guided within the positive guide, as a drive means for the breech. The drive can be transmitted by sliding rollers, gear wheels, or the like, which are driven by a motor, etc. The drive itself continues to run during the times when the weapon is stationary, while the breech is moved out, and back in again later during the times in which it is stationary. A slider is integrated between the drive means and the driver, and releases the driver from the breech. For this purpose, a slider has a slide cam, along which the driver is guided and is raised.

The purpose of the present invention is to specifically describe a drive for feeding the weapon breech to the cartridge chamber, in which the breech is automatically decoupled from the drive, particularly, in the event of a misfire or a late fire.

SUMMARY OF THE INVENTION

The object of invention is achieved by the features of a first embodiment, which pertains to a drive provided with a quick stop device for a breech (3), or breech support, which can be moved in the axial direction with respect to a weapon barrel (1), having at least one motor or the like, two chains (6) that run in opposite senses, sprocket wheels (5) around which the chains (6) are passed, driver studs (7) and control studs (8), which are integrated on the chain (6), a slide (11), which is mounted on two guide bolts at the bottom on the breech (3) such that it can be moved transversely with respect to the firing direction, wherein a groove (12) is located in the slide (11), in which groove (12) the driver studs (7) on the respective chains (6) engage, in order to drive the breech (3) forward and backward in the firing direction, wherein times in which the breech (3) is stationary in the front limit position are implemented in that the driver stud (7), which transports the breech (3) forward, is moved out of the groove (12), while the slide (11) is at the same time moved to its central position via its run-on ramp (13) by means of the control stud (8) on the same chain (6), and when a shot has been fired, the slide (11) is moved from the central position to the other weapon side, while the slide (11) remains in its central position when no shot has been fired, such that none of the driver studs (7) can drive the breech (3) to the rear. Advantageous embodiments are described below as follows.

In accordance with a second embodiment of the present invention, the first embodiment is modified so that a bevel gear (9) rotates two pinion shafts (10), wherein the bevel gear (9) is driven by the motor, or the like, and the two chains (6) are set in motion via the two preferably rear sprocket wheels (5) such that the latter rotate in opposite senses/directions. In accordance with a third embodiment of the present invention, the first embodiment or the second embodiment are further modified so that when the slide (11) is in the central position, an upper web of a holder (14) that is fixed to the weapon housing is located in the groove (12) in the slide (11), by which means the breech (3) is connected in an interlocking manner to the weapon housing. In accordance with a fourth embodiment of the present invention, the first embodiment, the second embodiment, and the third embodiment are further modified so that a lever (15) is rotated by a stud (21) of a barrel lock (2) during weapon recoil, by which means the slide (11) is guided to its left-hand position, along its chamfer (20), by means of a tab (16), which is in the form of a wedge, on the lever (15).

In accordance with a fifth embodiment of the present invention, the third embodiment and the fourth embodiment are further modified so that, until the start of its rearward movement, the breech (3) remains locked in its forward position and, during loading, in the rear position, for which purpose a locking catch (17) is arranged such that it can pivot on the holder (14), engages in the groove (12) in the slide (11), and thus holds the breech (3) in its position. In accordance with a sixth embodiment of the present invention, the fifth embodiment is further modified so that the corresponding driver stud (7) on the chains (6) preferably runs from underneath into the groove (12) in the slide (11), so the locking catch (17) is forced out of the groove (12) and releases the breech (3) for transport.

In an application that was submitted in parallel with the present application, a drive is proposed provided with a quick stop device with a chain to which at least two driver studs are fitted. The chain is passed around at least two sprocket wheels, and is preferably arranged underneath the breech. A slide is mounted in a guide at the bottom on the breech/breech support such that the slide can move transversely with respect to the firing direction, and a groove extends over the entire width of this slide. The respective driver stud moves the breech via this groove, forward in the firing direction or backward after the shot. The times during which the breech is stationary, in the front limit position, are implemented in that the driver stud, which transports the breech forward, is moved out of the groove and is moved backward on the other weapon side without the breech. When a shot is fired, the slide is then moved to the other weapon side, while on the other hand it remains in its position in which it has been moved away from the driver stud when the shot is not fired, as a result of which no further driver stud can drive the breech to the rear.

The present invention is based on the idea of integrating two chains which run in opposite senses (directions) as a drive. The rotary movement of the external drive, for example, an electric motor, is converted via this chain drive to a forward and backward movement of a breech/breech support.

The axes of the sprocket wheels, in accordance with the present invention, are preferably transverse with respect to the firing direction, and are, in this case, preferably disposed underneath the breech. One of the chains moves the breech forward, and the other chain moves it backward. In practice, the breech is moved forward by one of the two chains on the left-hand side of the weapon, while the other chain drives the breech backward on the right-hand side of the weapon (or vice versa).

In order to allow the breech to be stationary for times in the limit positions, the breech is disconnected from the drive in its front and rear positions. This can be done by decoupling the driver studs of the drive from the breech. In one preferred embodiment, in order to move the breech, these driver studs engage in a slide, which is located underneath the breech and can be moved transversely with respect to the firing direction. In its left-hand position, the slide functionally engages with the driver on one of its chains (i.e., the left-hand chain), and in its right-hand position it functionally engages with the driver on the other chain (i.e., the right-hand chain). During the times when the breech is stationary, the driver studs each leave the slide when the slide has assumed its central position. In this central position, the slide and, therefore, the breech are disconnected from both chains.

When the right-hand chain has driven the breech forward, the slide is moved to its central position by a control stud, which follows the driver, on the right-hand chain, and in the process is disconnected from the drive. In this position, the breech is locked, the cartridge is fired, and the weapon recoils. By means of this recoil (it is also possible to use gas pressure), the slide is moved to the left-hand (other) side of the weapon or breech, from where the slide can be driven backward by the left-hand chain via the driver stud on this left-hand chain.

When a shot is fired correctly, the breech is moved by the second chain to the rear position. Here, the slide is once again shifted or moved to its central position by the control stud on the second chain, and is disconnected from the drive for the rear waiting time of the breech. Whilst the next cartridge has been placed in front of the breech, the slide is pushed to the other (right-hand) side by an element, for example, a feeder. The driver stud on the first (right-hand) chain now moves from underneath into the groove in the slide, and once again drives the breech forward.

In contrast, if the cartridge does not fire, the slide is not moved to the left because there is no weapon recoil, but it remains in its central position. The breech cannot be unlocked, and also cannot be driven back.

BRIEF DESCRIPTION OF THE DRAWINGS

The invention will be explained in more detail, using at least one exemplary embodiment, and with reference to the drawings, in which.

DETAILED DESCRIPTION OF THE INVENTION

Figure 1:
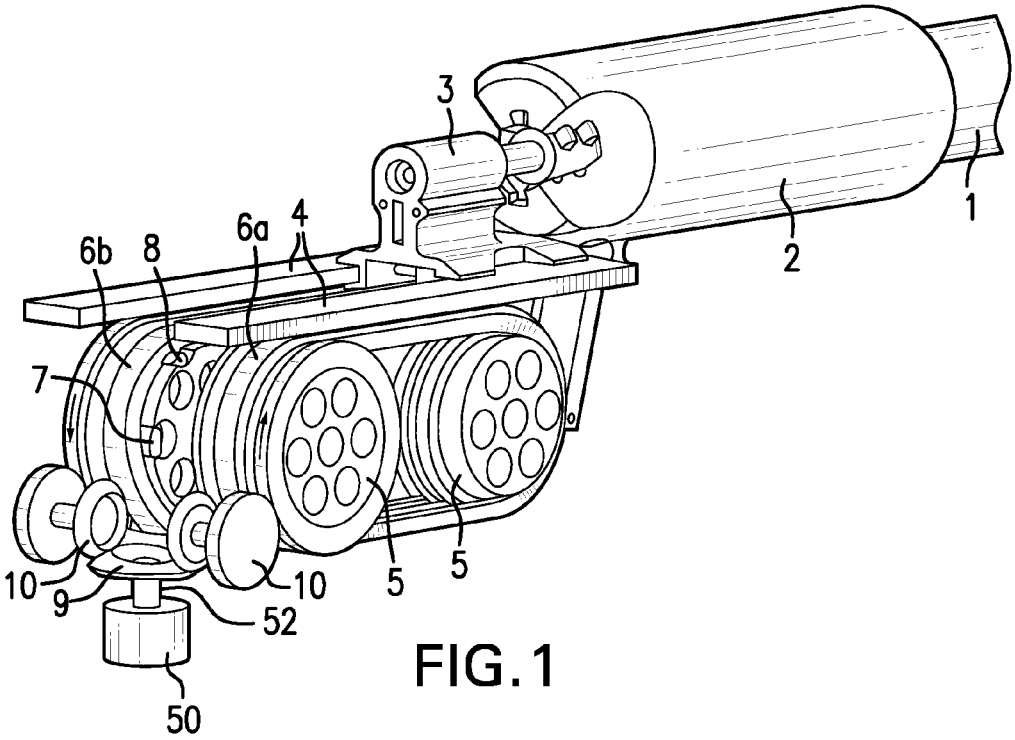
FIG. 1 shows an illustration of a breech drive, in accordance with the present invention, provided with chains and sprocket wheels arranged underneath a breech, from a rear perspective view, with the breech in the front position.

FIG. 1 shows an illustration of a breech drive, according to the present invention, which is provided with two chains 6*a*, 6*b* on the right and left, respectively, as seen in the firing direction, for an externally driven machine gun (weapon). A weapon barrel 1 of the weapon is mounted in a barrel lock 2 (e.g., in this case a locking bush), in which a breech 3 is also locked in its front position (See FIG. 1). The breech 3 can be moved on breech guides 4 in the direction of the weapon barrel axis.

Sprocket wheels 5 and the two chains 6 are preferably arranged underneath the breech 3, or the breech guides 4, or some other breech support. The breech drive is provided via a bevel gear 9, which rotates two pinion shafts 10. The bevel gear 9 is driven by a motor or a drive of this kind (not illustrated in any more detail than by the schematic box 50), directly or indirectly by transmission means 52, and sets the two chains 6 in motion by means of the pinion shafts 10 and the two rear sprocket wheels 5, such that the two sprocket wheels rotate in opposite senses or directions as shown by the arrows in FIG. 1. The upper strand of the chain 6*a* is moved in the firing direction on the right-hand side of the weapon, and the upper strand of the chain 6*b* is moved in the opposite direction on the left-hand side of the weapon. Both chains 6*a*, 6*b* each have a driver stud 7 and a control stud 8.

Figure 2:
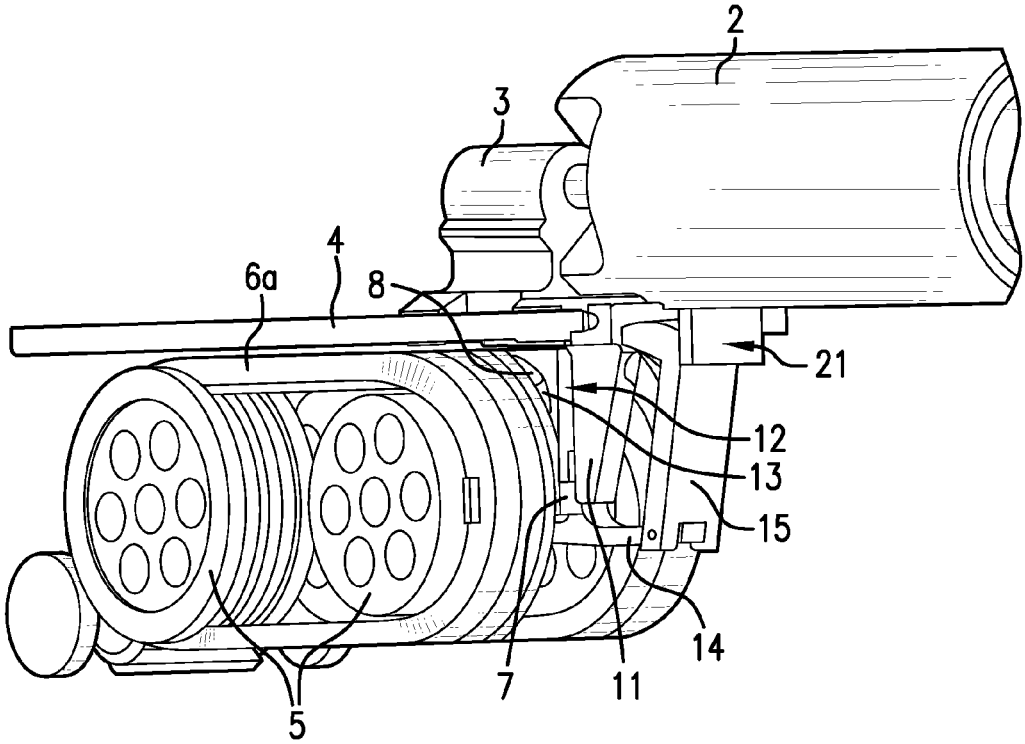
FIG. 2 shows a front perspective view of the breech drive from FIG. 1.

FIG. 2 shows a slide 11 that is mounted on two guide bolts at the bottom on the breech 3, such that the slide 11 can be moved transversely with respect to the firing direction. A groove 12 is located in the slide 11, in which groove 12 the driver studs 7 on the chains 6 engage, in order to drive the breech 3 forward and backward in the firing direction.

Figure 7:
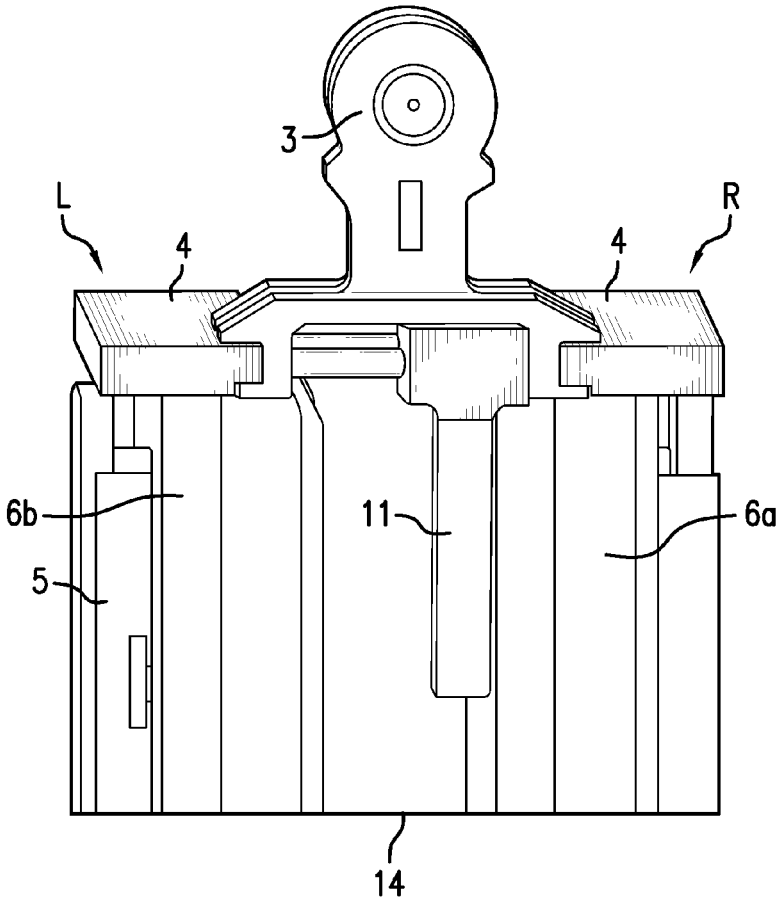
FIG. 7 shows the breech drive, as seen in the firing direction (i.e., a view from the rear), with the slide 11 in the right-hand position.

In order to transport the breech 3 forward, the driver stud 7 on the right-hand chain 6*a* engages in the groove 12, with the slide 11 located in its right-hand position (See FIG. 7). This results in an interlocking connection, in the longitudinal direction of the weapon, between the breech drive and the breech 3, wherein the breech 3 is accelerated and braked via a sinusoidal function (i.e., in a sinusoidal manner), which is predetermined by the radius of the sprocket wheels 5.

The times in which the breech 3 is stationary in the front limit position (See, e.g., FIG. 1) are implemented in that the driver stud 7, on the right-hand chain 6*a*, travels downward out of the groove 12 in the slide 11, while the slide 11 is, at the same time, moved to its central position (See FIG. 4) via its run-on ramp 13 by means of the control stud 8 on the same chain 6*a*. The upper web 28 of a holder 14, which is fixed to the weapon housing 60 of the weapon, is therefore located in the groove 12, by which means the breech 3 is connected, when in its front position, in an interlocking manner to the weapon housing 60 (See FIG. 3). In this position, the slide 11 does not engage with the driver stud 7 either on the right-hand chain 6*a* or on the left-hand chain 6*b*.

Figure 4:
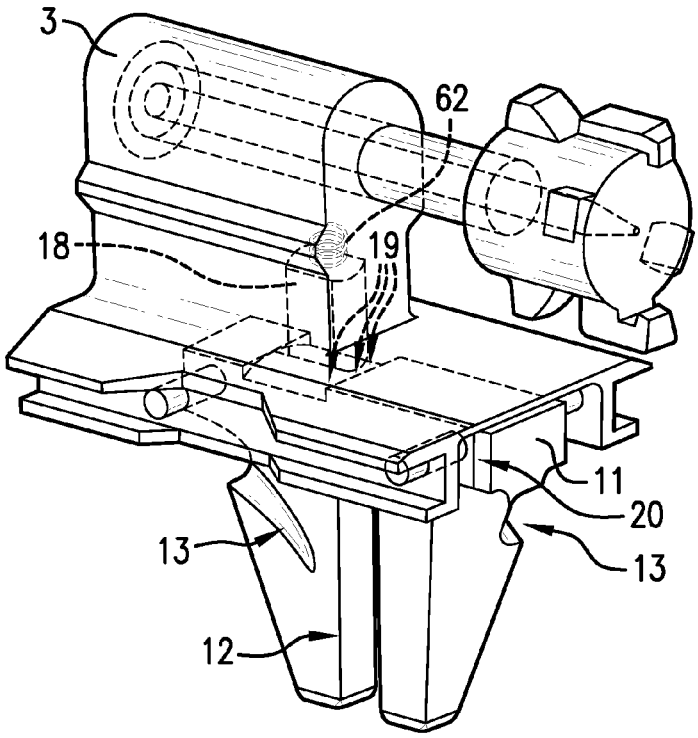
FIG. 4 shows the assemblies from FIG. 3, with some features illustrated in a transparent (phantom) form (as seen from the left in the firing direction)

In order to secure the slide 11 against inadvertent movement when in the right-hand, left-hand and central positions, in one simple variant, inclined surfaces on the underneath of the bolt 18 grip against surfaces 19, which are arranged parallel, on an upper portion of the slide 11 (See FIG. 4). In this case, a spring 62 permanently presses the bolt 18 against the surface 19, and therefore ensures that the slide 11 can be moved transversely with respect to the breech 3 only against a correspondingly high force (i.e., a force high enough to overcome the frictional force between the surface 19 of the slide 11 and the inclined surfaces of the bolt 18 caused by the spring 62 pressing the inclined surfaces of the bolt 18 against the surface 19 of the slide 11).

When the breech 3 is in the front, locked position, a firing bolt (not illustrated in any more detail) is released, by which means a shot is fired. Weapon recoil then occurs, and can be used to move the slide 11 to its left-hand position (See FIG. 5). Alternatively, a build-up of gas pressure can also be used to move the slide 11 to its left-hand position due to weapon recoil.

The lever 15, which is used for this function of moving the slide 11 to its left-hand position due to weapon recoil, should be considered as an example. This function of moving the slide 11 to its left-hand position could also be carried out in a different manner, for example, by using the gas pressure instead of the weapon recoil, or by using an intermediate buffer spring. The latter could better tolerate weapon recoils of different length.

Figure 3:
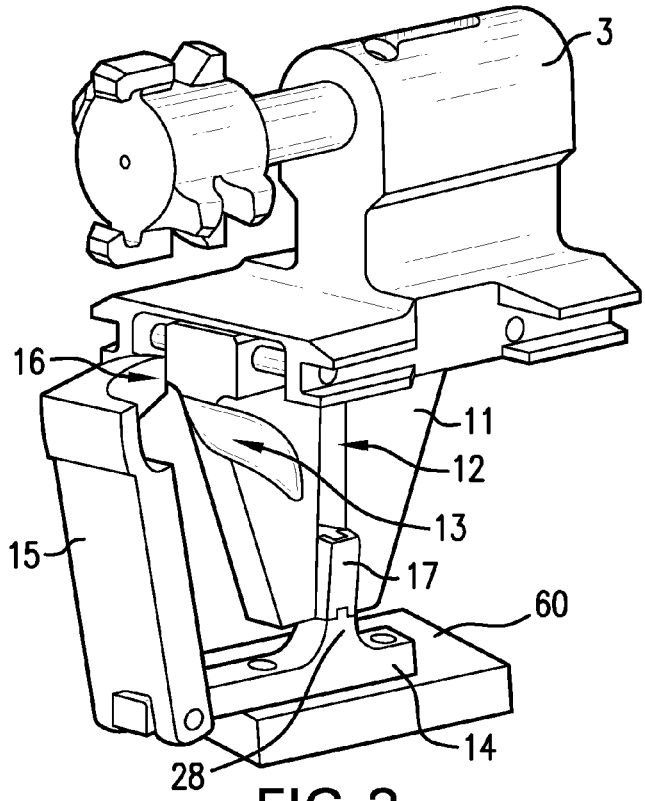
FIG. 3 shows the major assemblies for moving a slide, which is integrated in the breech drive (as seen from the right in the firing direction), with other structures omitted for clarity.
Figure 5:
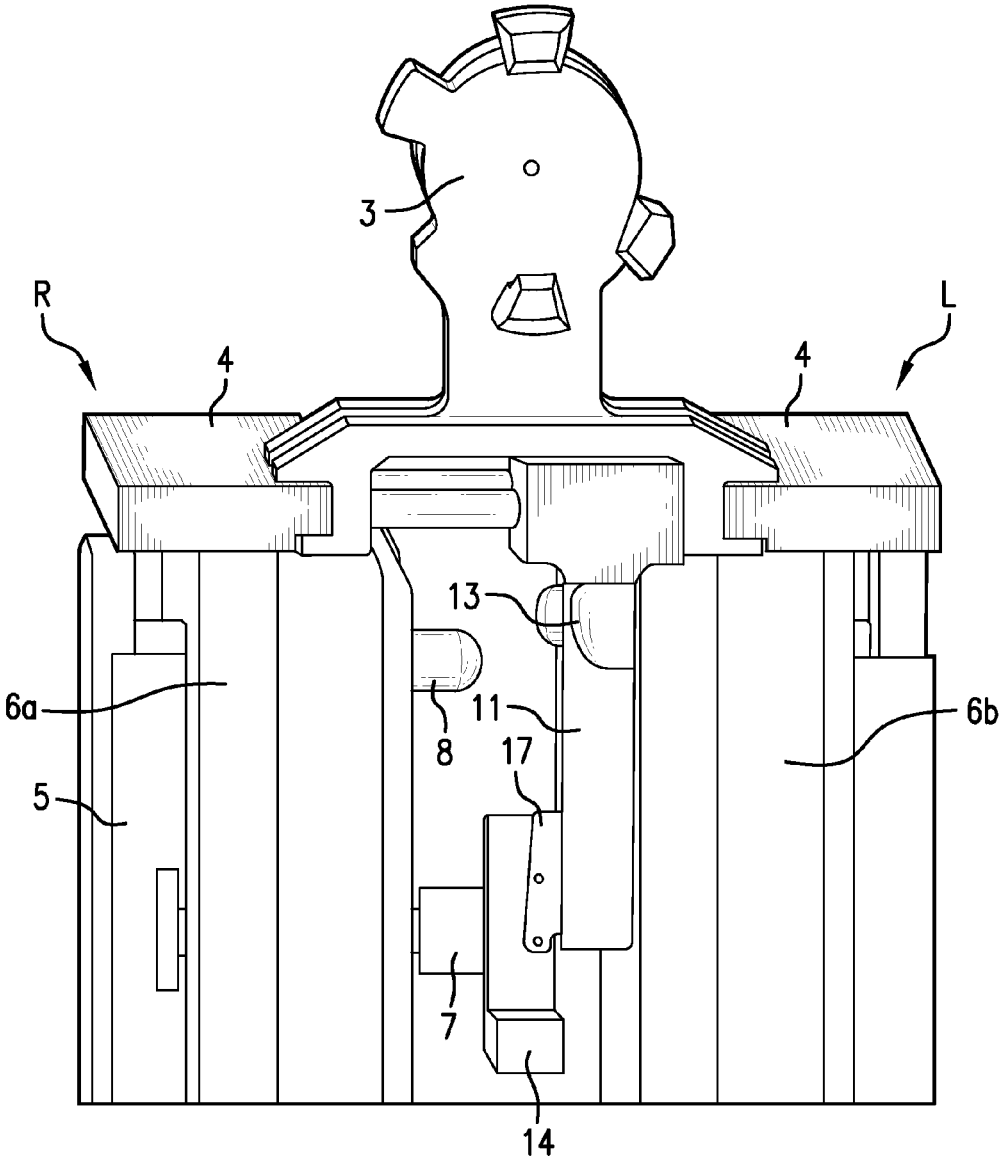
FIG. 5 shows the breech drive, as seen in the opposite direction to the firing direction (i.e., a view from the front) with the slide 11 in the left-hand position.

In FIG. 3, the lever 15 is rotated during weapon recoil by the stud 21 (FIG. 2) on the barrel lock 2, and its wedge-shaped tab 16 moves the slide 11 by its chamfer 20 (FIG. 4) to its left-hand position (FIG. 5).

FIG. 5 shows this left-hand position of the slide 11, seen in the opposite direction to the firing direction (with minor discrepancies in the correct position of the driver and control studs 7, 8). To assist in understanding the orientation shown in FIG. 5, the character reference "L" designates the left-hand side of the weapon and the character reference "R" designates the right-hand side of the weapon. In order to ensure that the breech 3 remains locked in its front position until the start of its rearward movement, a locking catch 17 is arranged on the holder 14 such that it can pivot. The locking catch 17 engages in the groove 12 in the slide 11, and thus holds the breech 3 in its position.

Figure 6:
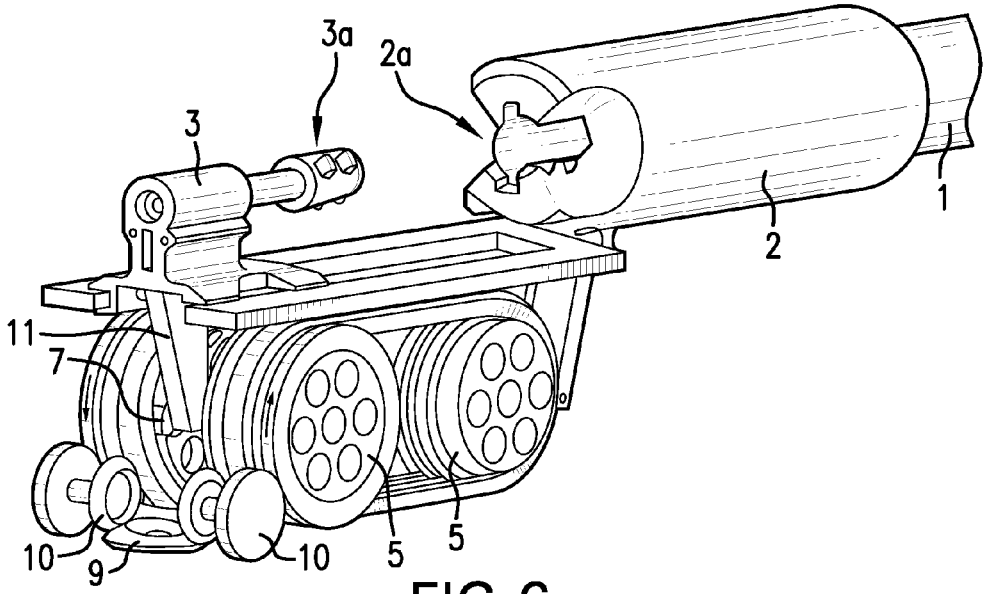
FIG. 6 shows the breech drive of FIG. 1 with the breech in the rear position.

The driver stud 7 on the left-hand chain 6*b* then enters the groove 12 in the slide 11 from underneath, with the locking catch 17 being pushed out of the groove 12, allowing the breech 3 to be moved to its rear position (See FIG. 6) in the opposite direction to the firing direction. In the rear position (FIG. 6), the driver stud 7 on the left-hand chain 6*b* leaves the groove 12 in the slide 11, while the control stud 8 on the same chain 6*b* moves the slide back to its central position. In the rear position as well, a holder, which is not illustrated in any more detail, is provided and in this position connects the breech 3 to the weapon housing in an interlocking manner. As shown in FIG. 6, when the breech is in the rear position, the socket 2*a* of the barrel lock 2 has been separated from the catch head 3*a* of the breech 3. However, the catch head 3*a* (which is provided with bumps) and the socket 2*a* may lock together when the breech 3 is in the front position (See, e.g., FIG. 1). In FIG. 6, the space between the catch head 3*a* of the breech and the socket 2*a* of the barrel lock 2 is provided so that an ammunition shell may be disposed into the direction of the weapon barrel 1 and locked in place when the breech 3 returns to the front position so that the breech catch 3*a* and the socket 2*a* engage and lock together.

After a new cartridge has been fed, a lever, for example of a feeder, moves the slide 11 to the right-hand side of the weapon (See FIG. 7), as a result of which the driver stud 7 on the right-hand chain 6*a* drives the breech 3 forward again.

However, if no shot is fired, the slide 11 remains in its central position when this is forward. Since, in this central position, the slide 11 is not engaged with the driver stud 7 on either the right-hand chain 6*a* or on the left-hand chain 6*b*, unlocking cannot take place, and the breech 3 cannot be transported further to its rear position.

It is self-evident that it is also possible to use two motors as autonomous drives for the right-hand and left-hand chains 6*a*, 6*b*, within the scope of the inventive idea. This dual motor embodiment requires synchronization of the two motors and the slight impression that the entire drive unit is physically larger.

According to the present invention a drive is provided with a quick stop device operably connected to a breech 3, or breech support, of a weapon, wherein the breech or breech support is moveable between a front limit position and a rear position in an axial direction with respect to a weapon barrel of the weapon. The above disclosure pertains mainly to the drive. However, in accordance with the present invention, the quick stop mechanism is provided by various components of the drive, such as by slide 11, and by operation of the control studs 7, 8, and associated structures connected to the breech 3. More specifically, when the breech 3 is found in the front position, the slide 11 is brought into the central position by means of the run-on ramp 13 and the control stud 8 of the chain 6*a*. The slide 11 remains in the central position when there is no shot. The control stud 7 cannot reach into the slide 11. Therefore, while the motor 50 may continue to run, the weapon system is placed in a "stop" mode (i.e., a quick stop).

The invention claimed is:

1. A drive provided with a quick stop device operably connected to a breech, or breech support, of a weapon, wherein the breech or breech support is moveable between a front limit position and a rear position in an axial direction with respect to a weapon barrel of the weapon, wherein the drive comprises:

(a) at least one motor;

(b) two chains arranged to run in opposite directions with respect to each other;

(c) a plurality of sprocket wheels around which the chains are passed, wherein the at least one motor is operably connected to rotate the plurality of sprocket wheels so as to set the two chains in motion in opposite directions;

(d) a driver stud and a control stud are integrated on each chain;

(e) a slide is mounted at a bottom of the breech so that the slide is moveable transversely with respect to a firing direction of the weapon, wherein a groove is located in the slide so that the driver stud on each chain is moveable to engage the groove in order to drive the breech forward and backward in the firing direction between the front limit position and the rear position, wherein a first chain of the two chains moves to drive the breech forward in the firing direction and a second chain of the two chains moves to drive the breech backward in the firing direction, wherein times in which the breech is stationary in the front limit position are implemented when the driver stud of the first chain that transports the breech forward is moved out of the groove, while at the same time the slide is moved to a central position via engagement of a run-on ramp of the slide with the control stud on the first chain, and when a shot has been fired, the slide is moved from the central position to a left hand position of the left hand side of the weapon, and wherein the slide remains in the central position when no shot has been fired so that none of the driver studs of the two chains are positioned to drive the breech to the rear position.

2. The drive as claimed in claim 1, wherein a bevel gear is disposed to rotate two pinion shafts, wherein the bevel gear is driven by the motor and the two chains are set in motion via two rear sprocket wheels so that the two rear sprocket wheels rotate in opposite directions.

3. The drive as claimed in claim 1, wherein, when the slide is in the central position, an upper web of a holder that is fixed to a weapon housing of the weapon engages the groove in the slide so that the breech is connected in an interlocking manner to the weapon housing.

4. The drive as claimed in claim 1, further comprising:

(f) a lever that is rotated by a stud of a barrel lock of the weapon during weapon recoil, wherein the lever guides the slide to the left hand position, along a chamfer of the slide, by engaging a tab on the lever, in the form of a wedge, with the chamfer of the slide.

5. The drive as claimed in claim 3, wherein, until a start of a rearward movement, the breech remains locked in the front limit position and, during loading, in the rear position, a locking catch is arranged so as to pivot on the holder to engage in the groove in the slide, so the locking catch holds the breech in the front limit position.

6. The drive as claimed in claim 5, wherein the corresponding driver stud on the two chains runs from underneath into the groove in the slide, thereby forcing the locking catch forced out of the groove and releasing the breech for transport.

7. The drive as claimed in claim 1, wherein the slide is mounted on two guide bolts at the bottom on the breech so that the slide is moveable transversely with respect to the firing direction.

8. The drive as claimed in claim 2, wherein, when the slide is in the central position, an upper web of a holder that is fixed to a weapon housing of the weapon engages the groove in the slide so that the breech is connected in an interlocking manner to the weapon housing.

9. The drive as claimed in claim 2, further comprising:

(f) a lever that is rotated by a stud of a barrel lock of the weapon during weapon recoil, wherein the lever guides the slide to the left hand position, along a chamfer of the slide, by engaging a tab on the lever, in the form of a wedge, with the chamfer of the slide.

10. The drive as claimed in claim 3, further comprising:

(f) a lever that is rotated by a stud of a barrel lock of the weapon during weapon recoil, wherein the lever guides the slide to the left hand position, along a chamfer of the slide, by engaging a tab on the lever, in the form of a wedge, with the chamfer of the slide.

11. The drive as claimed in claim 8, wherein, until a start of a rearward movement, the breech remains locked in the front limit position and, during loading, in the rear position, a locking catch is arranged so as to pivot on the holder to engage in the groove in the slide, so the locking catch holds the breech in the front limit position.

12. The drive as claimed in claim 9, wherein, until a start of a rearward movement, the breech remains locked in the front limit position and, during loading, in the rear position, a locking catch is arranged so as to pivot on a holder to engage in the groove in the slide, so the locking catch holds the breech in the front limit position.

13. The drive as claimed in claim 10, wherein, until a start of a rearward movement, the breech remains locked in the front limit position and, during loading, in the rear position, a locking catch is arranged so as to pivot on the holder to engage in the groove in the slide, so the locking catch holds the breech in the front limit position.

14. The drive as claimed in claim 4, wherein, until a start of a rearward movement, the breech remains locked in the front limit position and, during loading, in the rear position, a locking catch is arranged so as to pivot on a holder to engage in the groove in the slide, so the locking catch holds the breech in the front limit position.

15. The drive as claimed in claim 11, wherein the corresponding driver stud on the two chains runs from underneath into the groove in the slide, thereby forcing the locking catch forced out of the groove and releasing the breech for transport.

16. The drive as claimed in claim 12, wherein the corresponding driver stud on the two chains runs from underneath into the groove in the slide, thereby forcing the locking catch forced out of the groove and releasing the breech for transport.

17. The drive as claimed in claim 13, wherein the corresponding driver stud on the two chains runs from underneath into the groove in the slide, thereby forcing the locking catch forced out of the groove and releasing the breech for transport.

18. The drive as claimed in claim 14, wherein the corresponding driver stud on the two chains runs from underneath into the groove in the slide, thereby forcing the locking catch forced out of the groove and releasing the breech for transport.

* * * * *